US006688225B2

(12) United States Patent
Shields

(10) Patent No.: US 6,688,225 B2
(45) Date of Patent: Feb. 10, 2004

(54) SYSTEM FOR COOLING INK AND OTHER LIQUIDS ON A PRINTING PRESS

(75) Inventor: Gerald N. Shields, Chicago, IL (US)

(73) Assignee: Graymills Corporation, Chicago, IL (US)

( * ) Notice: Subject to any disclaimer, the term of this patent is extended or adjusted under 35 U.S.C. 154(b) by 0 days.

(21) Appl. No.: 10/283,861

(22) Filed: Oct. 30, 2002

(65) Prior Publication Data

US 2003/0121436 A1 Jul. 3, 2003

Related U.S. Application Data

(60) Provisional application No. 60/339,057, filed on Oct. 30, 2001.

(51) Int. Cl.[7] ..... B41F 3/40; B21B 45/02

(52) U.S. Cl. ..... 101/364; 101/216; 101/487; 15/256.52

(58) Field of Search ..... 101/364, 350.6, 101/362, 367, 216, 487, 187, 142; 118/262; 15/256.52

(56) References Cited

U.S. PATENT DOCUMENTS 3,701,335 A * 10/1972 Barnscheidt ..... 15/256.52
5,676,754 A * 10/1997 Helms ..... 101/187
5,784,957 A * 7/1998 Rau ..... 101/216

FOREIGN PATENT DOCUMENTS

DE 29612843 * 9/1996
DE 19625362 * 2/1998

* cited by examiner

*Primary Examiner*—Eugene H. Eickholt
(74) *Attorney, Agent, or Firm*—Marshall, Gerstein & Borun LLP

(57) ABSTRACT

An ink cooling system for printing presses is disclosed. The ink cooling system is arranged to cool ink at locations within a printing press at the locations in which the ink properties are most likely to be adversely impacted, and which locations are or may be physically remote from the centralized ink supply or ink tanks. The disclosed system thus counteracts localized heating that commonly occurs in printing presses, thus minimizing or eliminating printing problems caused by heated ink.

36 Claims, 13 Drawing Sheets

SYSTEM FOR COOLING INK AND OTHER LIQUIDS ON A PRINTING PRESS

RELATED APPLICATIONS

This application claims priority from U.S. provisional application Ser. No. 60/339,057, filed Oct. 30, 2001.

FIELD OF THE INVENTION

The present invention relates generally to printing presses and, more specifically, to a system for cooling ink and/or coatings on printing presses.

BACKGROUND OF THE INVENTION

It is known that the normal operation of a printing press produces heat. On many printing components, this heat may be the result of friction. For example, the anilox roll makes direct contact with the doctor blades in the chamber doctor blade system. Friction between the doctor blades and the anilox roll may cause one or more of these components to heat up. Further, friction between the anilox roll and other components, such as the plate cylinder, likewise may cause the anilox roll and other components to generate still additional heat. Still further heat is generated by plate rolls and other press components, such as, for example, dryers. Finally, additional heat may result from the ambient heat in the press room.

According to normal thermodynamic processes, the generated heat is readily transferred to the ink used on the printing press. In some press components, such as the aforementioned chamber doctor blade system, a relatively small quantity of ink may be exposed to a relatively high and localized heat source. Furthermore, the chamber or the pan may function as a heat sink, providing another avenue for routing heat to the ink.

As the ink heats up, various components of the ink may be lost, such as, by way of example rather than limitation, volatiles, solvents, amines, etc. Unfortunately, this heated and altered ink tends to have a detrimental effect on the overall quality of the printing operation. Additives and the labor or equipment required to correct the ink properties add additional expense. Accordingly, it may be desirable to cool the ink in order to prevent the negative impact on print quality. However, merely cooling the general ink supply is not sufficient to address the localized heating that occurs at some of the press components. The foregoing discussion may be equally applicable to coating systems which apply liquid coatings to a web or other substrate in a printing press.

DETAILED DESCRIPTION OF THE PREFERRED EMBODIMENT

The examples described herein are not intended to be exhaustive or to limit the scope of the invention to the precise form or forms disclosed. Rather, the following exemplary embodiments have been chosen and described in order to best explain the principles of the invention and to enable others skilled in the art to follow the teachings thereof.

Figure 1:
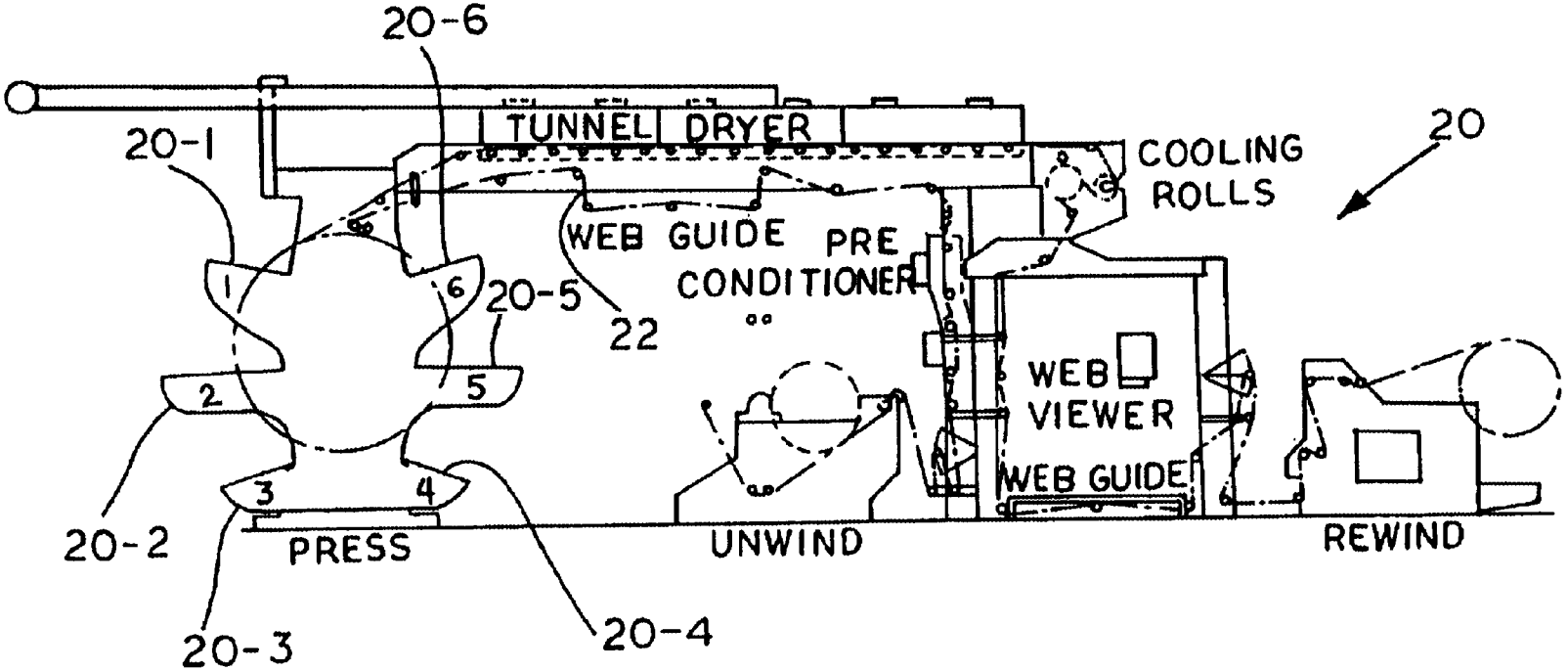
FIG. 1 is an elevational view of a six color flexographic common impression printing press.

Referring now to FIG. 1 of the drawings, a six color flexographic common impression printing press of the type commonly known in the art is referred to by the reference numeral 20. It will be understood that the teachings of the present invention may be equally applicable to other types of printing presses in addition to those presses specifically mentioned herein. The press 20 typically includes a plurality of printing stations, for example 20-1 through 20-6, for applying ink to a web 22. As would be known, each of the printing stations 20-1 through 20-6 includes a system for applying ink to an anilox roll, such as a doctor blade system (FIGS. 4 and 6 through 11), or a fountain pan system (FIG. 5), which are discussed in greater detail below. Each station 20-1 through 20-6, as well as the press 20, also include a plurality of other components, all of which may be conventional and would be known to those of skill in the art.

Figure 2:
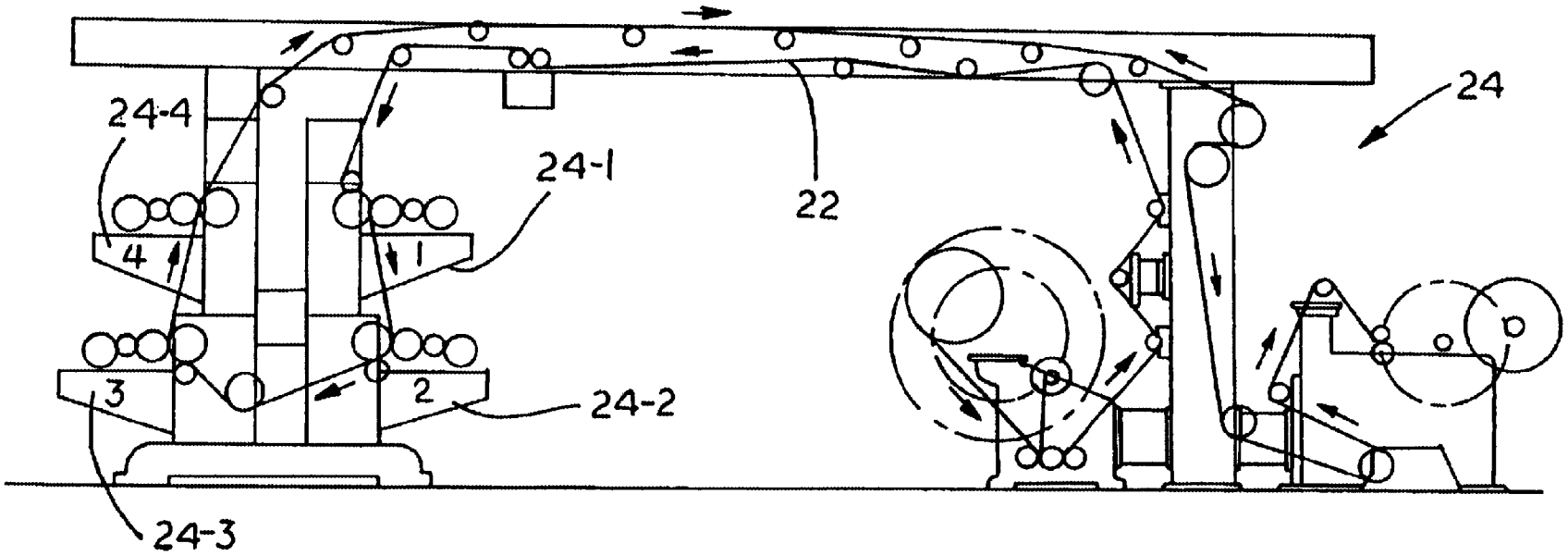
FIG. 2 is an elevational view of a wide web stack type flexographic printing press.

Referring now to FIG. 2 of the drawings, a wide web stack type flexographic printing press of the type commonly known in the art is referred to by the reference numeral 24. The press 24 typically includes a plurality of printing stations, for example 24-1 through 24-4, for applying ink to the web 22. As would be known, each of the printing stations 24-1 through 24-4 includes a system for applying ink to an anilox roll. Again, such a system may comprise a doctor blade system (FIGS. 4 and 6 through 11), or a fountain pan system (FIG. 5). Each station 24-1 through 24-4 as well as the press 24 includes a plurality of other components, all of which may be conventional and would be known to those of skill in the art.

Figure 3:
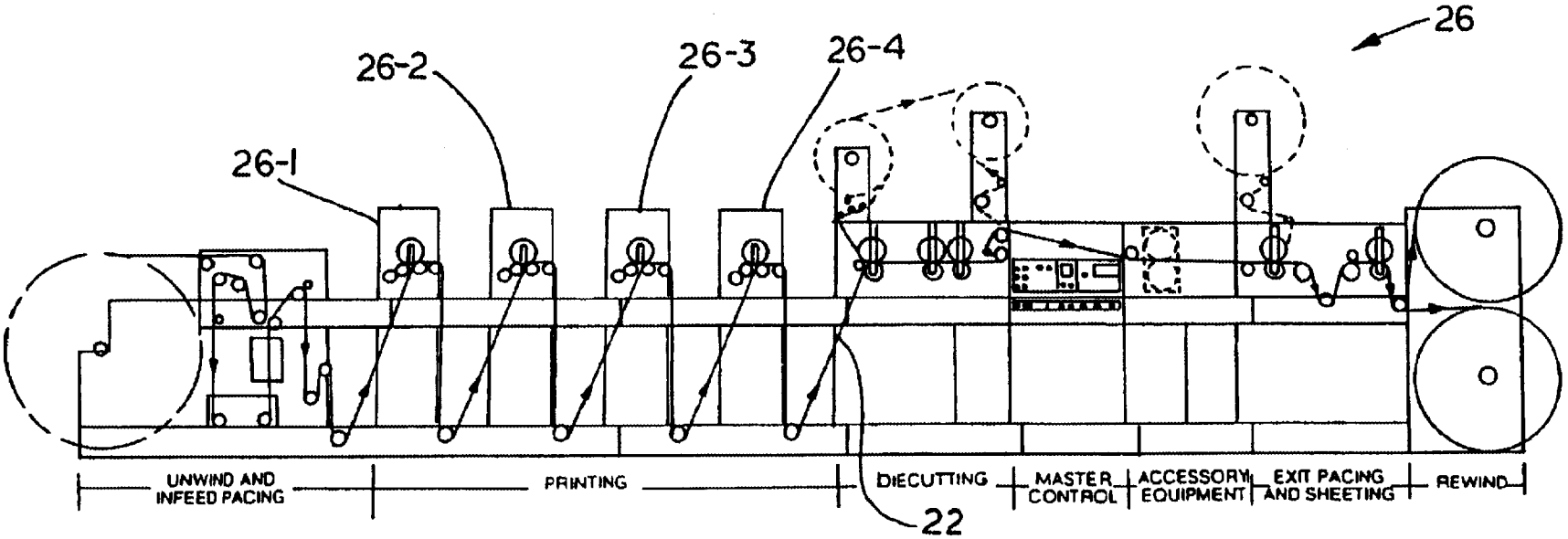
FIG. 3 is an elevational view of a narrow web in-line flexographic printing press.

Referring now to FIG. 3 of the drawings, a narrow web in-line flexographic printing press of the type commonly known in the art is referred to by the reference numeral 26. The press 26 typically includes a plurality of printing stations, for example 26-1 through 26-4, for applying ink to the web 22. As would be known, each of the printing stations 26-1 through 26-4 includes a system for applying ink to an anilox roll. Again, such a system may comprise a doctor blade system (FIGS. 4 and 6 through 11), or a fountain pan system (FIG. 5). Each station 26-1 through 26-4 as well as the press 26 includes a plurality of other components, all of which may be conventional and would be known to those of skill in the art. Again, the above-identified presses 20, 24 and 26 are mentioned herein for purposes of illustration only. The use of other types of presses may be contemplated. For the sake of convenience, the following discussion will refer only to the press 20. It will be understood that the teachings described herein may be equally applicable to each of the aforementioned presses 20, 24, 26, and to any flexographic, gravure, and/or offset lithographic presses. Further, it will be understood that the teachings described herein may be applicable to other systems and/or methods of applying inks, coatings, and/or other materials to a substrate.

Figure 4:
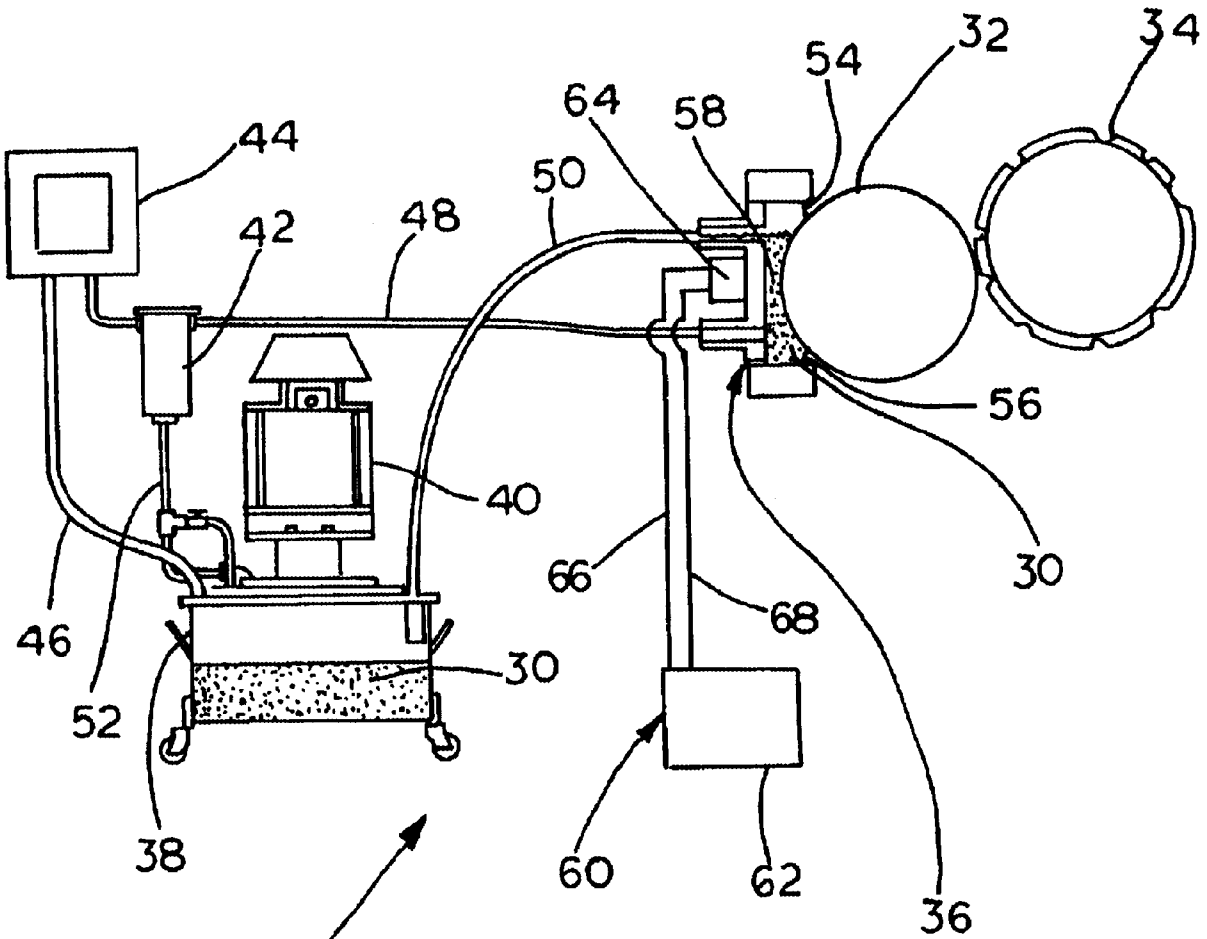
FIG. 4 is a schematic representation of a flexographic ink train system for supplying ink to the chamber doctor blade system on a printing press and also employing a localized ink cooling system assembled in accordance with the teachings of the present invention.
Figure 5:
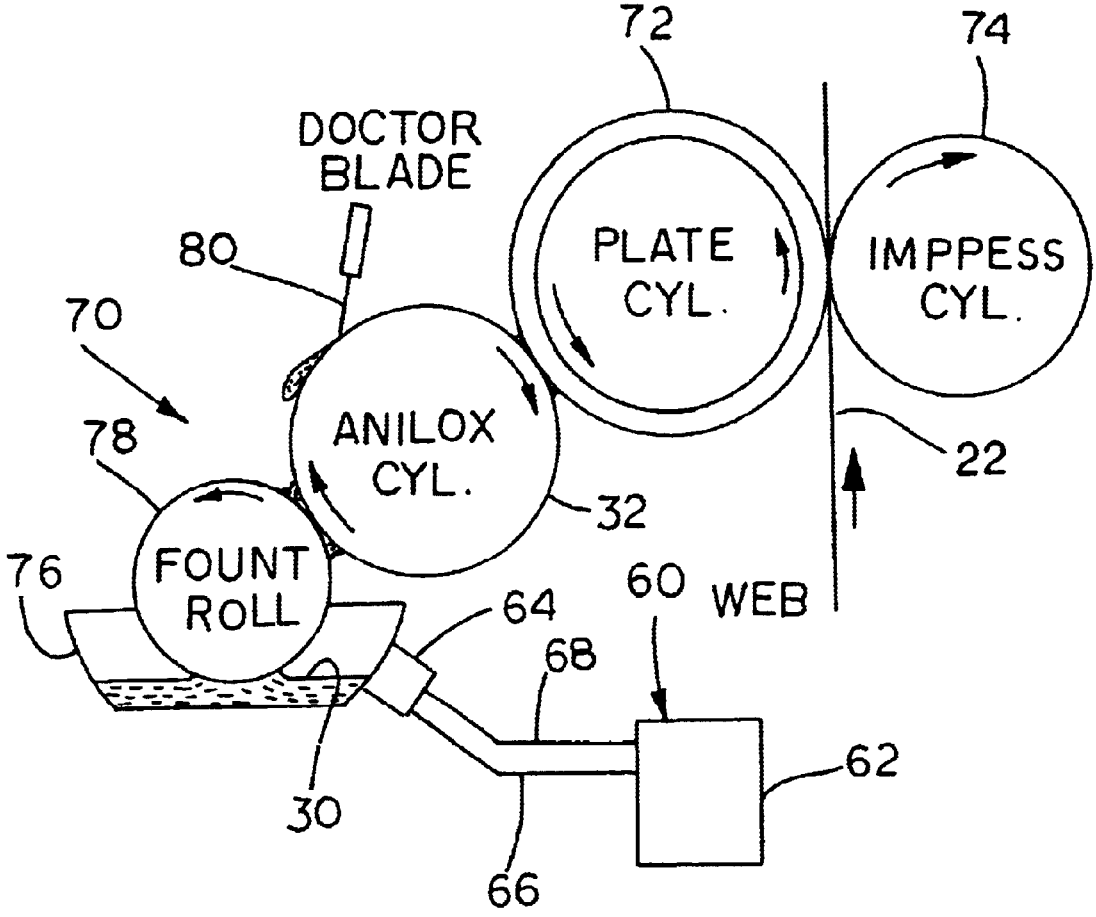
FIG. 5 is a fragmentary elevational view of a fountain roll for applying ink to an anilox roll and employing a single reverse angle doctor blade and also employing a localized ink cooling system assembled in accordance with the teachings of the present invention.
Figure 6:
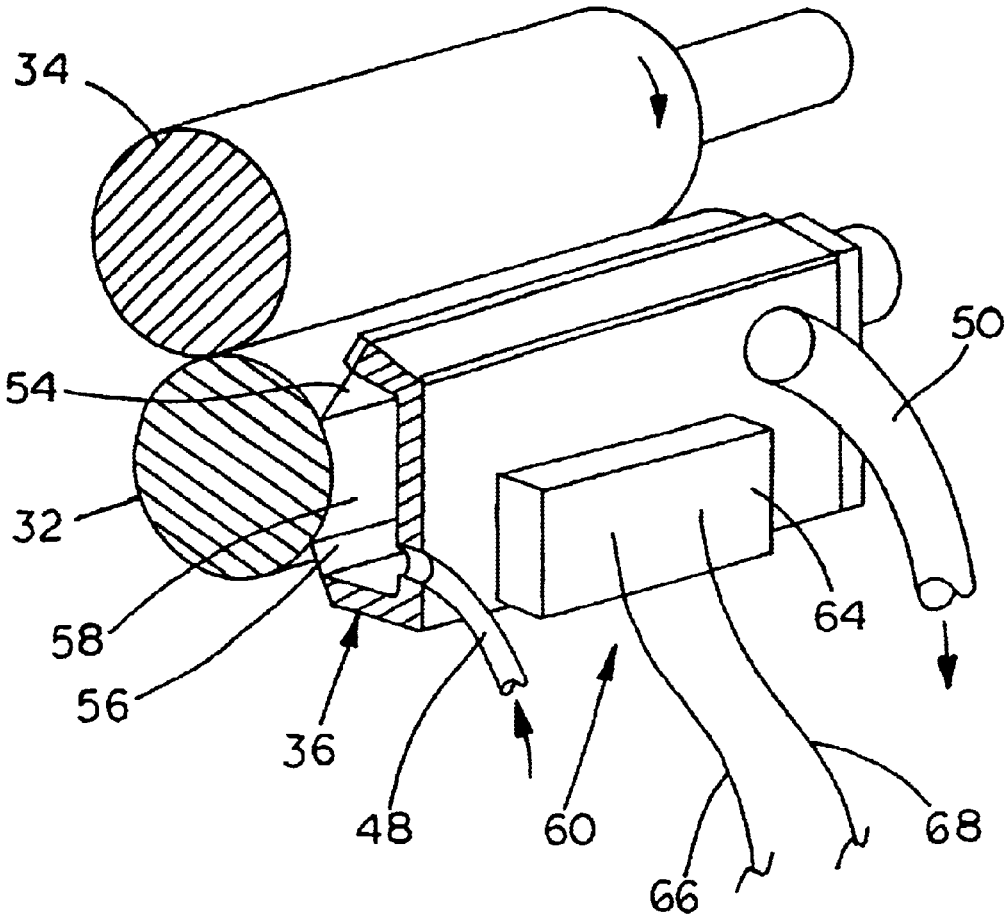
FIG. 6 is an enlarged fragmentary view in perspective of an enclosed doctor blade system for applying ink to an anilox roll and also employing a localized ink cooling system assembled in accordance with the teachings of the present invention.
Figure 7:
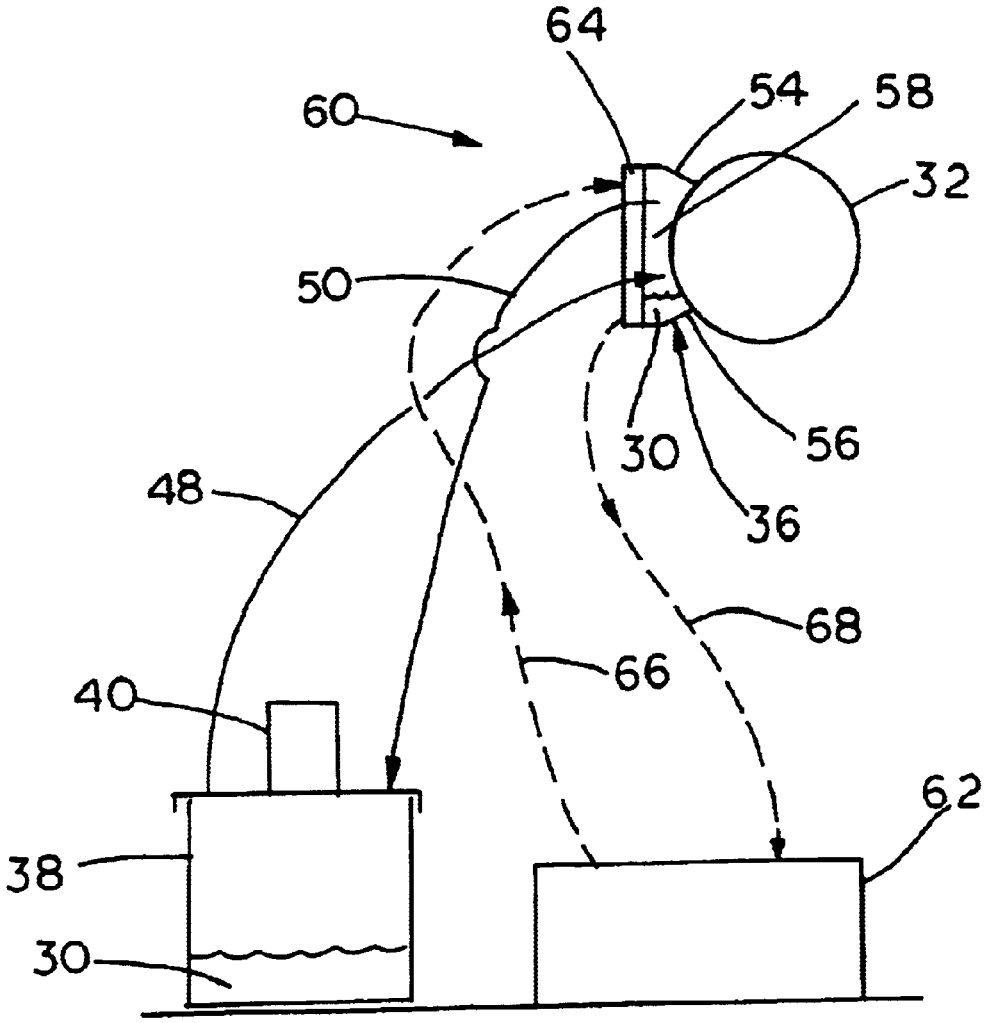
FIG. 7 is a schematic illustration showing a system for supplying ink to an enclosed doctor blade system and also employing a localized ink cooling system assembled in accordance with the teachings of the present invention.
Figure 8:
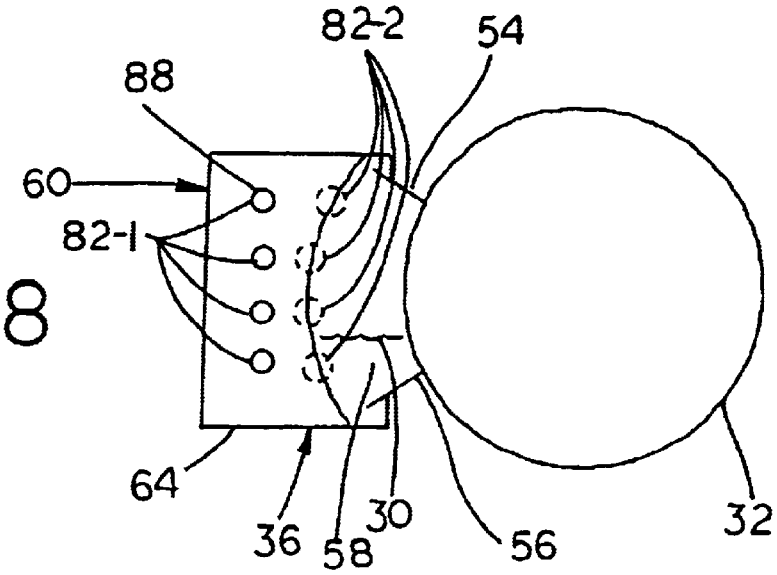
FIG. 8 is an enlarged fragmentary elevational view of an enclosed doctor blade system and illustrating a plurality of coolant supply tubes running through a portion of the enclosed chamber.

Referring now to FIGS. 4, 6 and 7, a flexographic ink train system 28 is used to apply ink 30 to an anilox roll 32 on the press 20, for subsequent application to a plate cylinder 34 (FIGS. 4 and 6). As outlined above, the system 28 may be equally applicable to any one of the presses 20, 24, 26 mentioned above. The system 28 includes an enclosed chamber doctor blade system 36, an ink tank 38, a pump 40, a filter 42, and a viscosity controller 44. A plurality of lines 46, 48, 50, and 52 are provided for routing to the ink 30 to and between the various components. The doctor blade system 36 includes a pair of doctor blades 54, 56 as would be known, and further includes a chamber 58 which contains a quantity of the ink 30. The ink 30 is supplied to the doctor blade system 36 via the line 48, and is returned through the line 50 to the ink tank 38 in a conventional manner.

The system 28 is provided with an ink cooling system 60 assembled in accordance with the teachings of a first disclosed example of the present invention. The system 60 includes a refrigeration unit 62 and an exchange unit 64. The exchange unit 64 is mounted to the chamber 58 so as to cool the ink 30 disposed within the chamber 58. A supply line 66 routes a refrigerant (which may be any one of a number of commercially available refrigerants) or other coolant medium, such as chilled water, to the exchange unit 64, and a return line 68 returns the refrigerant to the refrigeration unit 62. The cooling operation carried out by the refrigeration unit 62 and the exchange unit 64 may be conventional using well known refrigeration/cooling principles. It will be understood that the refrigeration unit 62 will typically include a pump, a compressor, an expansion valve, etc., and other conventional components (not shown) as would be known. It will be understood that the aforementioned components may also be applied to a system for applying coatings to a web or other substrate in order to cool the coating material in a similar manner.

Referring now to FIG. 5, a fountain roll system 70 for applying the ink 30 to the anilox roll 32 is shown. Also shown are a plate cylinder 72 and an impression cylinder 74, which cooperate to apply the ink 30 to the web 22 in a conventional manner. The fountain roll system 70 includes an ink pan 76 and a fountain roll 78 which rotates in the ink pan 76 so as to pick up a quantity of the ink 30 contained therein for transfer to the anilox roll 32. The fountain roll system 70 also includes one or more doctor blades, with a single reverse angle doctor blade 80 shown.

The system 70 also includes the ink cooling system 60 similar to that outlined above. The exchange unit 64 is mounted to the ink pan 76 so as to cool the ink 30 disposed within the ink pan 76. The supply line 66 and the return line 68 route the refrigerant between the exchange unit 64 and the refrigeration unit 62. Again, the cooling operation carried out by the refrigeration unit 62 and the exchange unit 64 may be conventional using well known refrigeration/cooling principles.

The exchange unit 64 may take a number of forms. For example, referring now to FIG. 8, the exchange unit 64 shown therein includes a plurality of cooling chambers or tubes 82 which are routed through the chamber 58 of the doctor blade system 36. The cooling tubes 82 include a first set of cooling tubes 82-1 and a second set of cooling tubes 82-2. The cooling tubes 82 may include enhanced surface features, such as fins, plate-fins, and/or other structures or surface treatments, to enhance the heat exchange effect. The second set of cooling tubes 82-2 are shown running through the chamber 58 so as to come into direct contact with at least a portion of the ink 30 disposed within the chamber 58.

Figure 9:
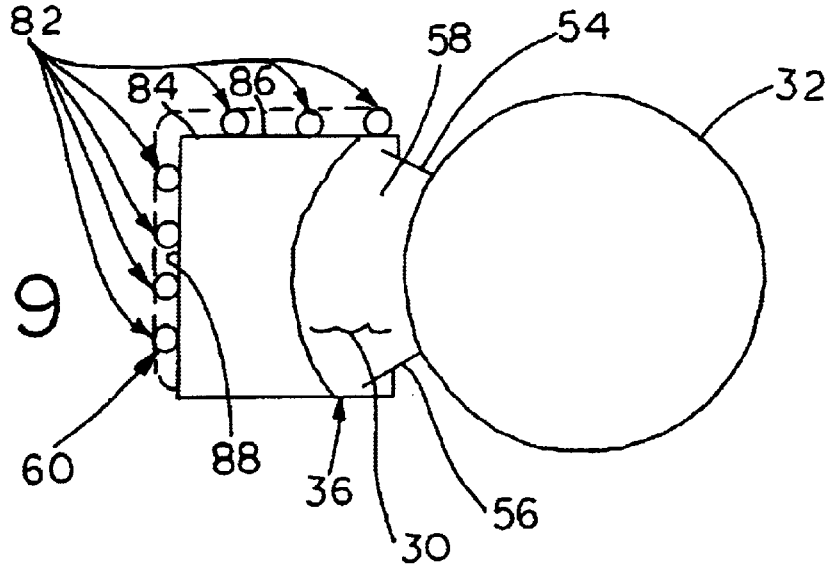
FIG. 9 is an enlarged fragmentary elevational view similar to FIG. 8 and illustrating a plurality of coolant supply tubes running around an external surface of the enclosed chamber.

Referring now to FIG. 9, the exchange unit 64 shown therein includes a plurality of cooling chamber or tubes 82 which are routed along an exterior portion 84 of the chamber 58 of the doctor blade system 36. The cooling tubes 82 may run in contact with a number of exterior surfaces, for example the surfaces 86 and 88, in order to cool the ink 30 housed within the chamber 58. An insulating, protective, or restraining covering (shown in dotted lines) may be placed over the tubes.

Figure 10:
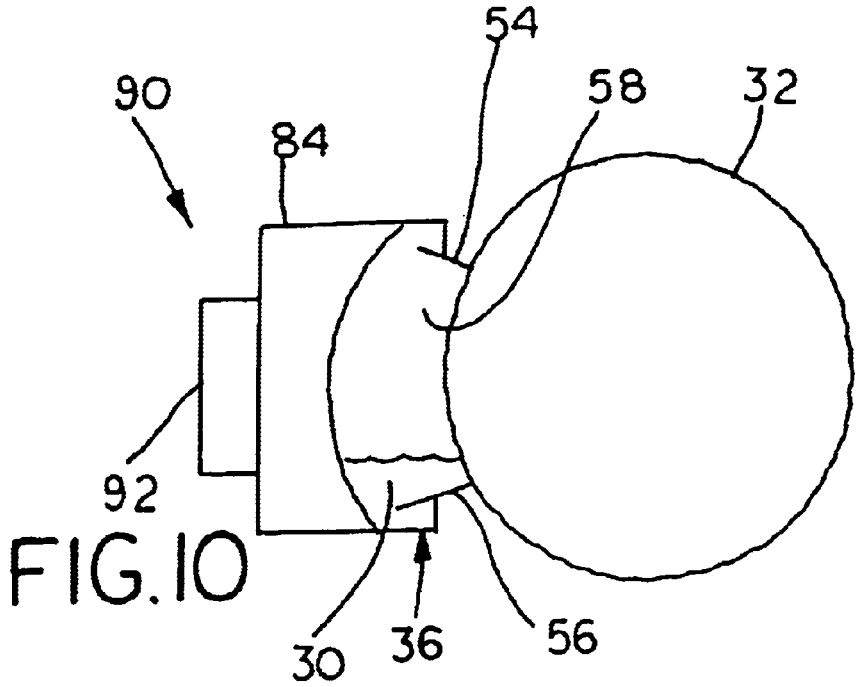
FIG. 10 is an enlarged fragmentary elevational view similar to FIGS. 8 and 9 and illustrating an electronic cooling device mounted on an external surface of the enclosed chamber.
Figure 11:
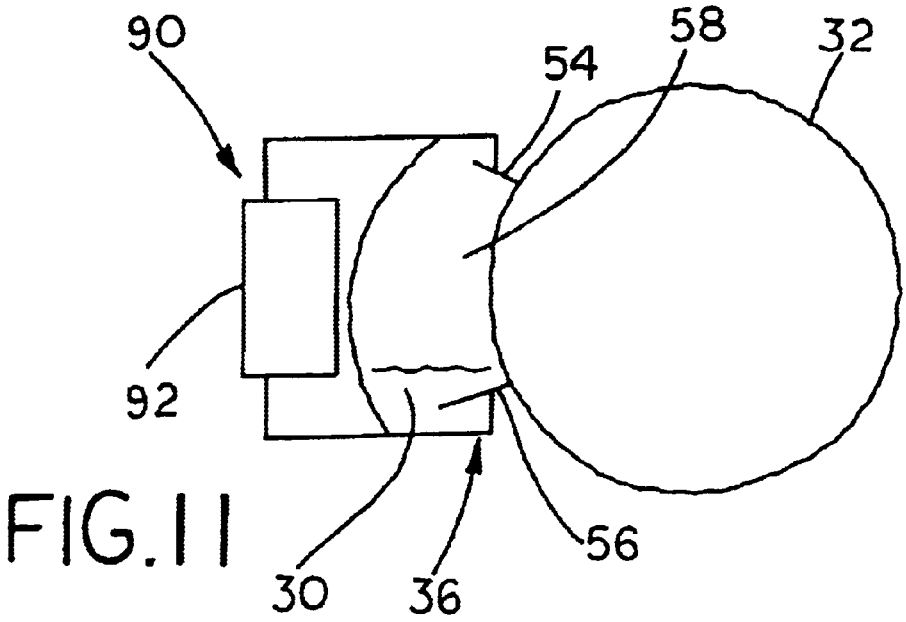
FIG. 11 is an enlarged fragmentary elevational view similar to FIG. 10 and illustrating an electronic cooling device mounted internally within the enclosed chamber.

Referring now to FIGS. 10 and 11, an electronic cooling system 90 may be provided in place of, or in addition to, the more conventional refrigerant-based cooling system outlined above. In the embodiment of FIGS. 10 and 11, an electronic cooling component 92 is mounted to the exterior portion 84 of the doctor blade system 36 (FIG. 10), or, as an alternative, the cooling component 92 may be mounted to the doctor blade system 36 so as to extend into the chamber 58 so as to come into direct contact with at least a portion of the ink 30 housed therein. The electronic cooling component 92 may be a thermoelectric cooling device employing what is known as "the Peltier Effect". Such a cooling component 92 is a solid-state method of heat transfer through dissimilar semiconductor materials. Such electronic cooling components 92 are commercially available. One possible source is ThermoElectric Cooling America of Chicago, Ill. As is known, an electronic cooling system replaces the main working components of a conventional refrigerant-based system with a cold junction, a heat sink and a DC power source. The refrigerant in both liquid and vapor form is replaced by two dissimilar conductors. The cold junction (evaporator surface) becomes cold through absorption of energy by the electrons as they pass from one semiconductor to another, instead of energy absorption by the refrigerant as it changes from liquid to vapor. The compressor is replaced by a DC power source which pumps the electrons from one semiconductor to another. A heat sink replaces the conventional condenser fins, discharging the accumulated heat energy from the system.

Figure 12:
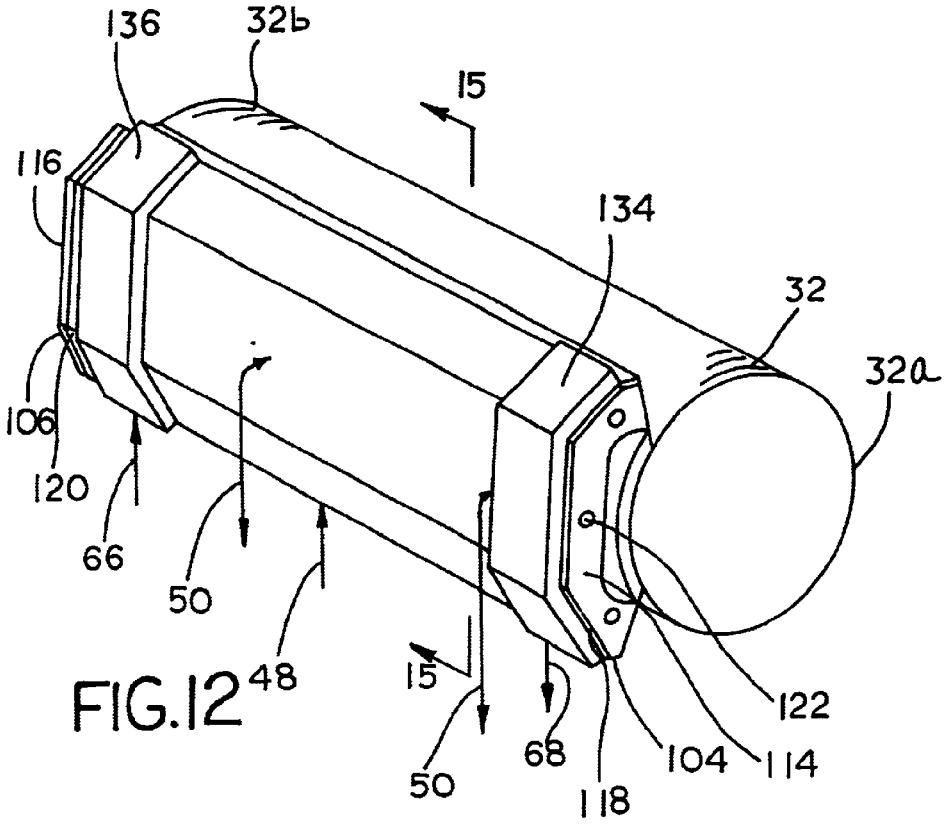
FIG. 12 is a perspective view of a doctor blade system incorporating an ink cooling system assembled in accordance with the teachings of yet another disclosed example of the present invention.

Referring now to FIG. 12, an ink cooling system assembled in accordance with the teachings of yet another disclosed example of the present invention is shown and is generally referred to by the reference numeral 102. The ink cooling system 102 is shown in conjunction with the anilox roll 32, and the ink cooling system 102 is operatively connected to the ink train system 28 of the type discussed above with respect to the earlier disclosed examples. It will be understood that the ink train system 28 (not shown in FIG. 12), includes an ink supply line 48, and an ink return line 50 which operate to route the ink 30 from the ink tank (not shown) in a manner similar to that discussed above (which may be similar or identical to the same elements as discussed above with respect to the earlier disclosed examples).

The ink cooling system 102 is incorporated into a doctor blade system, such as the doctor blade system 36 discussed above with respect to the earlier disclosed examples. It will be appreciated that the doctor blade system 36 extends essentially along a length of the anilox roll 32 such that the doctor blade system includes a first end 104 and a second end 106 which are disposed generally adjacent to opposing ends 32*a* and 32*b*, respectively of the anilox roll.

Figure 13:
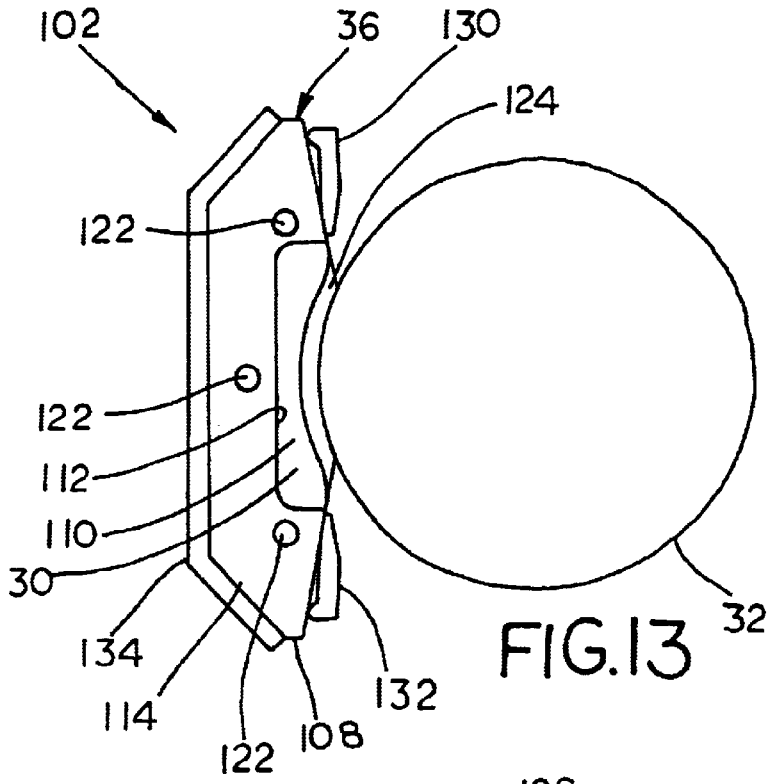
FIG. 13 is an enlarged end view thereof.
Figure 14:
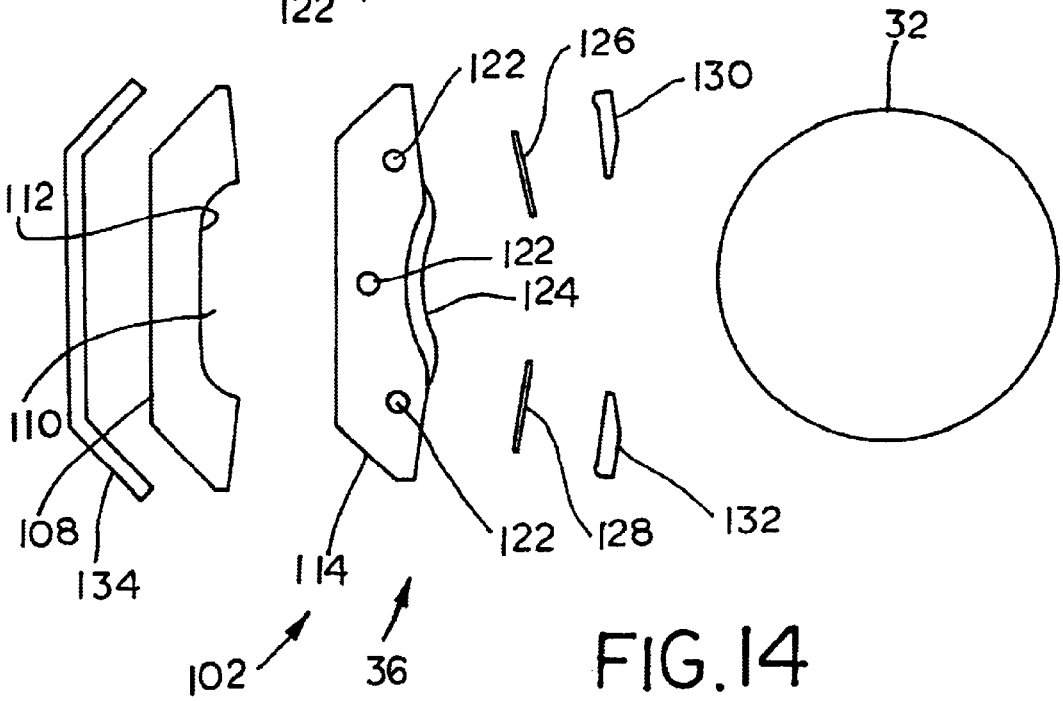
FIG. 14 is an exploded view thereof.

Referring now to FIGS. 13 and 14, the doctor blade system 36 is shown adjacent to the anilox roll 32. The doctor blade system 36 includes a housing 108 which defines an ink cavity 110. The ink cavity 110 is arranged to contain a quantity of the ink 30 between interior wall 112 of the housing 108 and the anilox roll 32. The doctor blade system 36 includes a pair of end caps 114, 116 (the end cap 116 is visible in FIG. 12 only). The end cap 114 is mounted to an end 118 of the housing 108 while the end cap 116 is mounted to an end 120 of the housing 108. Each end cap 114, 116 is secured to the housing 108 using a plurality of attachment bolts 122. Each end cap 114, 116 includes a seal 124, which preferable is a compressible seal of the type commonly employed in the art and which abuts the anilox roll 32 in a known manner in order to seal the ends of the cavity 110.

The doctor blade system 36 also includes an upper blade 126 and a lower blade 128, both of which extend generally along the length of the housing 108. Each blade 126, 128 includes a hold down bar 130, 132.

Referring again to FIG. 12, the doctor blade system 36 is operatively connected to the ink supply line 48, and may include one or more ink return lines 50. The ink cooling system 102 is also connected to the coolant supply line 66 and the coolant return line 68, both of which are operatively connected to a refrigeration unit (not shown, but which may be similar to the regrigeration unit discussed above with respect to the earlier disclosed examples), or to any other refrigeration unit capable of supplying a suitable coolant medium to the ink cooling system 102.

Figure 17:
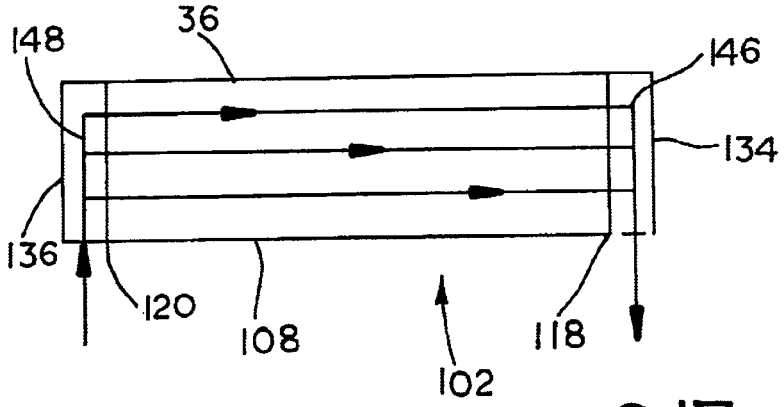
FIG. 17 is a schematic flow diagram illustrating the coolant flowing through the doctor blade system in a parallel flow arrangement.
Figure 18:
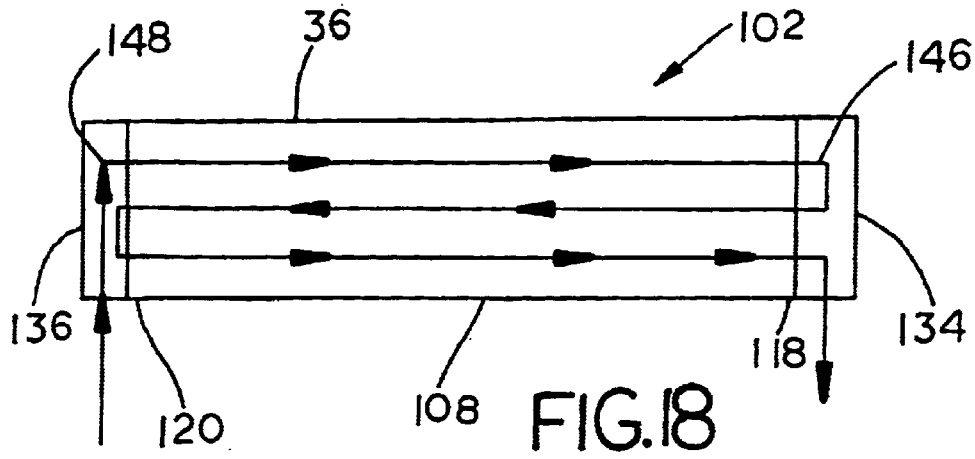
FIG. 18 is another schematic flow diagram illustrating the coolant flowing through the doctor blade system in a counter flow arrangement.
Figure 19:
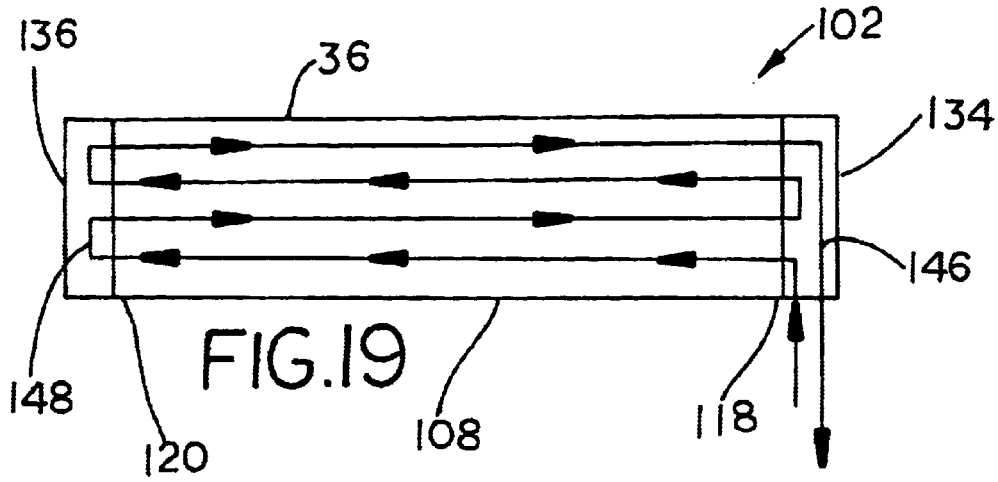
FIG. 19 is yet another schematic flow diagram illustrating the coolant flowing through the doctor blade system in another flow arrangement.

Preferably, the housing 108 is provided with a pair of headers 134, 136 (the header 136 is visible in FIG. 12 and schematically in FIGS. 17–19). The headers 134, 136 are disposed generally adjacent to the ends 118, 120, respectively of the housing 108. In the example shown, the coolant supply line 66 is routed to the header 136, while the coolant return line 68 is routed to the header 134.

Figure 15:
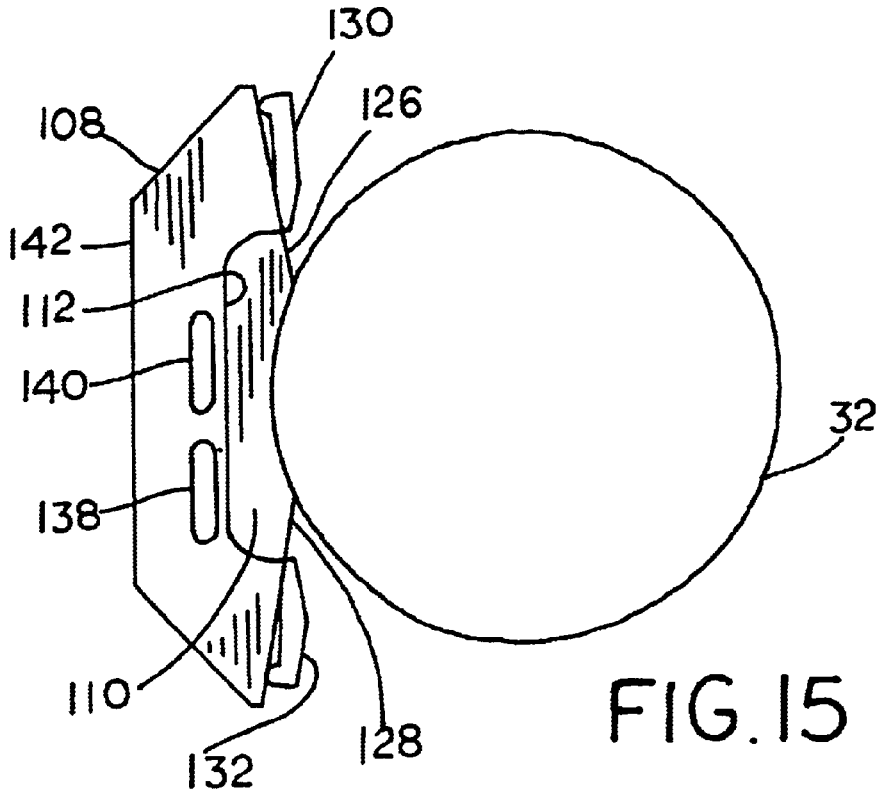
FIG. 15 is a cross-sectional view taken along line 15—15 of FIG. 12 and incorporating a first type of coolant flow passages.

Referring now to FIG. 15, the housing 108 includes a pair of internal flow passages 138, 140. The flow passages 138, 140 are defined in the cross section of the housing 108, generally between the interior wall 112 of the housing 108 and an exterior wall 142 of the housing 108. The coolant flow passages 138, 140 are in flow communication with the coolant supply and return lines 66, 68, such that the coolant entering the coolant supply line 66 will flow through the housing 108 via the passages 138, 140 and exit the housing 108 via the coolant return line 68. Thus, in accordance with the disclosed example, the ink 30 contained within the ink cavity 110 of the housing 108, which ink 30 may be warmer than is desired, will be cooled via heat transfer taking place between the warmer ink 30 and the coolant contained in the flow passages 138, 140.

Figure 16:
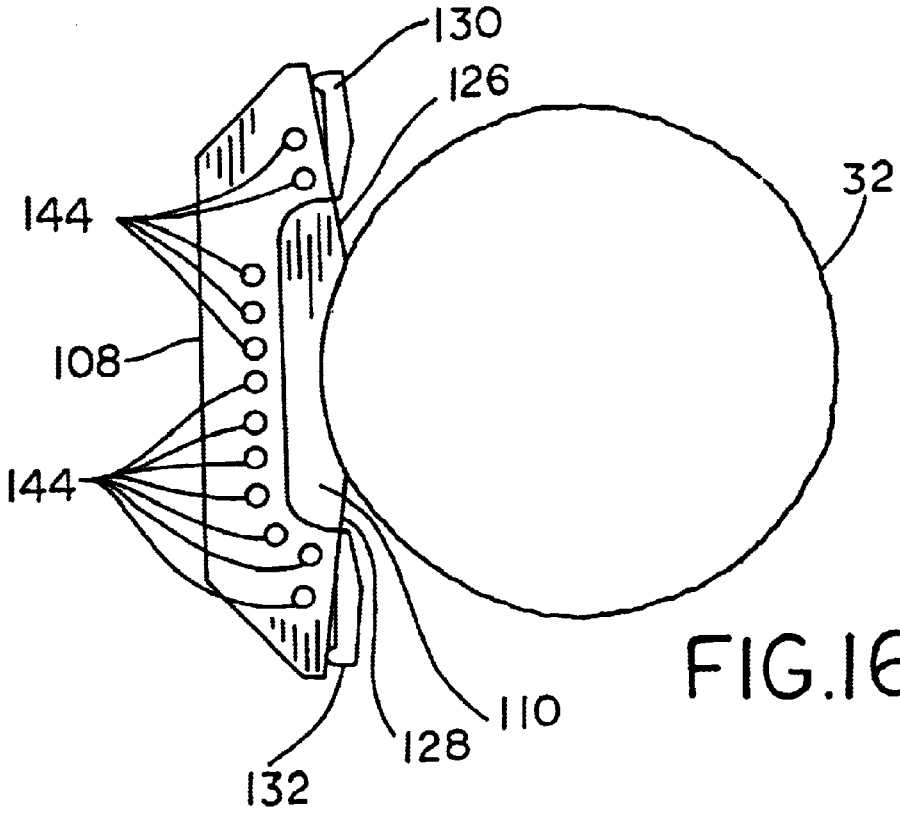
FIG. 16 is a cross-sectional view similar to FIG. 15 but incorporating a second type of coolant flow passages.

Referring now to FIG. 16, the housing 108 shown therein is equipped with a plurality of coolant flow passages 144, which are greater in number than the pair of flow passages 138, 140 as discussed with respect to FIG. 15. Other than the difference in the number of flow passages, the construction and operation of the ink cooling system 102 illustrated in FIG. 16 may be substantially similar to the structure and operation of the ink cooling system 102 shown in FIG. 15. With regard to both FIGS. 15 and 16, it will be appreciated that the housing 108 may be supplied with suitable ports or connections in order to route the coolant contained in the appropriate coolant flow passages from the appropriate ends of the housing 108 to the adjacent headers 134, 136 and thus to the coolant supply or return lines 66, 68. Also, in accordance with the disclosed example, the housing 108 shown in either FIG. 15 or 16 may be constructed of, for example, extruded or cast aluminum, or any other suitable material.

Figure 20:
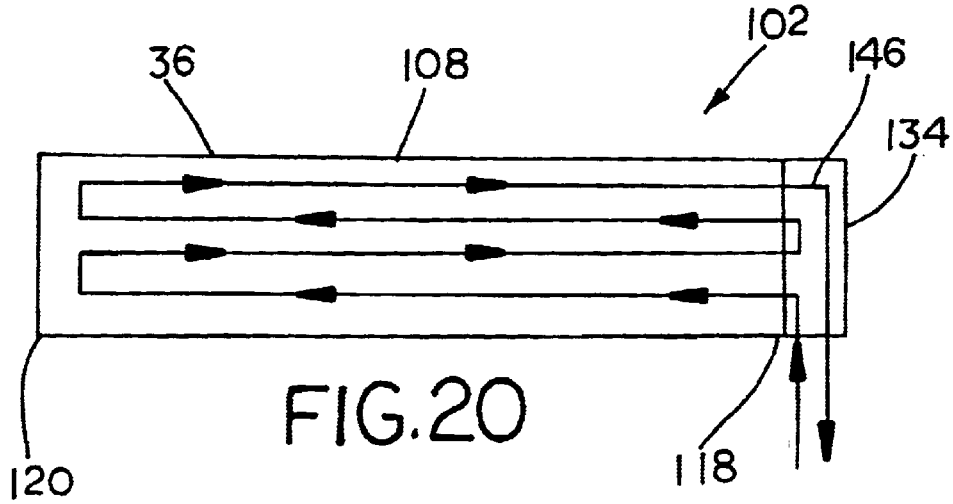
FIG. 20 is a still further schematic flow diagram illustrating the coolant flowing through the doctor blade system in another counter flow arrangement employing only a single header.

Referring now to FIGS. 17–20, it will be appreciated that the ink cooling system 102 may be readily adaptable to utilize either a parallel flow arrangement (FIG. 17) or a counter flow arrangement (FIGS. 18–20). It will further be appreciated that the ink cooling system may be provided with only a single header 134 at the end 118 of the housing 108, or alternatively, the ink cooling system 102 may incorporate the pair of headers 134, 136. A single flow path (FIGS. 18–20) or multiple flow paths (FIG. 17) may be provided. It will also be appreciated that the coolant supply line 66 and the coolant return line 68 may be in flow communication with the headers 134, 136 (FIGS. 17 and 18), or, as an alternative, the coolant supply line 66 and the coolant return line 68 may be in flow communication with only a single one of the headers, for example the header 134 illustrated in FIGS. 19 and 20.

In the disclosed examples, it will be understood that the headers 134 may be provided with suitable passages or ports 146, while the headers 136 may be provided with suitable passages or ports 148, in order to be in flow communication with the coolant flow passages 138, 140, or 144. Additionally, the passages may be internally interconnected, with such an example shown schematically in FIG. 20 adjacent the end 120.

In accordance with one or more of the disclosed examples, the doctor blade system 36 including the ink chamber typically extends along all or major portion of the length of the anilox roll 32. It is known that in many commercial applications the anilox roll 32 may be, for example, between about 4 feet and 8 feet in length. Typically, the end caps 114, 116 measure, for example, about one half inches thick. Typically, the seals 124 are formed of a foam-like material that is sandwiched between the appropriate end cap 114, 116 and the adjacent ends of the chamber 118, 120, respectively. The seals 124 are also held in place by the hold down bars 130, 132, which hold the doctor blades 126, 128 in place. The seals 124 are compressed against the surface of the anilox roll 32 and thus seal the ends of the ink chamber.

The anilox roll 32 typically has millions of cells. As the anilox roll 32 rotates, the cells rotate through the ink 30 contained within the chamber such that the cells fill with ink. Along the length of the anilox roll the blades 126, 128 act as seals to seal the chamber along the length of the anilox roll 32, and also scrape off any excess ink, thus leaving only what is contained in the cells for application to the raised image on the next cylinder (not shown) which is typically disposed on the opposite side of the anilox roll 32.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalence.

What is claimed:

1. A doctor blade system for use on a printing press and having an integrated cooling system comprising:

an elongated doctor blade housing, the housing having a first end and a second end and defining a cavity arranged to contain a quantity of ink;

the housing including a plurality of coolant passages, the coolant passages defining a coolant flow path extending between the first end and the second end, at least a portion of the coolant flow passages including a surface area in conductive heat transfer relationship with the cavity; and the housing further including a coolant inlet and a coolant outlet, the inlet and the outlet in flow communication with the path and disposed at opposite ends of the path, the coolant inlet adapted for flow communication with a coolant supply, the coolant outlet adapted for flow communication with a coolant return.

2. The device of claim 1, wherein the housing includes a top wall, a bottom wall, and a side wall, and wherein the coolant passages are defined in at least one of the top wall, the bottom wall and the side wall.

3. The device of claim 1, wherein the housing includes at least one wall having a cross section and abutting at least a portion of the cavity, and wherein at least some of the coolant passages are defined in the cross section.

4. The device of claim 1, wherein the housing includes a sidewall, and wherein at least some of the coolant passages are integrally formed in the sidewall.

5. The device of claim 4, wherein the housing comprises an extruded aluminum member.

6. The device of claim 4, wherein the housing comprises a cast member.

7. The device of claim 1, including a first header attached to the first end of the housing and a second header attached to the second end of the housing, and wherein a portion of the flow path proceeds through each of the first and second headers.

8. The device of claim 7, wherein the coolant inlet is defined in the first header and the coolant outlet is defined in the second header.

9. The device of claim 7, wherein the coolant inlet and the coolant outlet are defined are both defined in either the first header or the second header.

10. The device of claim 1, wherein the coolant passages are arranged to define a plurality of flow paths between the first end and the second end of the housing.

11. The device of claim 7, wherein the first header and the second header include a plurality of ports, each port providing flow communication between at least two of the coolant passages.

12. The device of claim 7, wherein the first and second headers include a plurality of ports, the ports arranged to provide flow communication between the first end of the housing and the second end of the housing in only a single direction.

13. The device of claim 7, wherein the first and second headers include a plurality of ports, the ports arranged to provide flow communication between the first end of the housing and the second end of the housing in a first direction and in a second direction.

14. The device of claim 7, wherein the first and second headers include a plurality of ports, the ports arranged to provide flow communication through only a selected number of the coolant passages.

15. The device of claim 7, wherein the first and second headers include a plurality of ports, the ports arranged to provide flow communication through only a selected number of the coolant passages.

16. The device of claim 1, in combination with a cooling unit having a coolant supply and a coolant return, the cooling unit arranged to receive and cool a coolant medium and to communicate the coolant medium to and from the housing.

17. A doctor blade system for use on a printing press and having an integrated cooling system comprising:

a doctor blade housing, the housing having a first end and a second end and defining a cavity arranged to contain a quantity of ink;

the housing having a cross-section defining a plurality of coolant passages integrally formed along a length of the housing, the coolant passages defining a coolant flow path extending between the first end and the second end, at least a portion of the coolant flow passages in conductive heat transfer relationship with a cooling surface area, the cooling surface area exposed to the cavity;

a cooling unit having a supply of coolant medium, the cooling unit having a coolant supply and a coolant return; and the housing including a coolant inlet in flow communication with the coolant supply and a coolant outlet in flow communication with the coolant return.

18. The device of claim 17, wherein the housing includes a wall extending between the first end and the second end, and wherein the coolant passages are internally formed in the wall.

19. The device of claim 17, wherein the housing comprises an extruded aluminum member.

20. The device of claim 17, wherein the housing comprises a cast member.

21. The device of claim 17, including a first header attached to the first end of the housing and a second header attached to the second end of the housing, and wherein a portion of the flow path proceeds through each of the first and second headers.

22. The device of claim 17, wherein the coolant inlet is defined in the first header and the coolant outlet is defined in the second header.

23. The device of claim 17, wherein the coolant inlet and the coolant outlet are defined are both defined in either the first header or the second header.

24. The device of claim 17, including a first header attached to the first end of the housing and a second header attached to the second end of the housing, and wherein the coolant passages are arranged to define a plurality of flow paths between the first end and the second end of the housing.

25. The device of claim 24, wherein the plurality of flow paths proceed in the same direction.

26. The device of claim 24, wherein a first one of the flow paths proceeds in a first direction and a second one of the flow paths proceeds in a second direction opposite to the first direction.

27. The device of claim 21, wherein the first header and the second header include a plurality of ports, each port providing flow communication between at least two of the coolant passages.

28. The device of claim 21, wherein the first and second headers include a plurality of ports, the ports arranged to provide flow communication between the first end of the housing and the second end of the housing in only a single direction.

29. The device of claim 21, wherein the first and second headers include a plurality of ports, the ports arranged to provide flow communication between the first end of the housing and the second end of the housing in a first direction and in a second direction.

30. A doctor blade system for use on a printing press and having an integrated cooling system comprising:

a doctor blade housing, the housing having a first end and a second end and defining an ink cavity arranged to contain a quantity of ink;

the housing having a cross-section defining a plurality of coolant passages extending generally along a length of the housing, the coolant passages defining a coolant flow path extending between the first end and the second end, at least a portion of the coolant flow passages exposed for conductive heat transfer relationship to the ink cavity;

the housing including a coolant inlet arranged for flow communication with a coolant supply, the housing further including a coolant outlet arranged for flow communication with the coolant return, the coolant inlet and the coolant outlet disposed at opposite ends of the path;

a first header attached to the first end of the housing; and a second header attached to the second end of the housing, a portion of the flow path proceeding through each of the first and second headers.

31. The device of claim 30, wherein the housing includes a wall extending between the first end and the second end, and wherein the coolant passages are internally formed in the wall.

32. The device of claim 30, wherein the housing comprises an extruded aluminum member.

33. The device of claim 30, wherein the housing comprises a cast member.

34. The device of claim 30, wherein the coolant inlet is defined in the first header and the coolant outlet is defined in the second header.

35. The device of claim 30, wherein the coolant inlet and the coolant outlet are both defined in either the first header or the second header.

36. The device of claim 30, including a first header attached to the first end of the housing and a second header attached to the second end of the housing, and wherein the coolant passages are arranged to define a plurality of flow paths between the first end and the second end of the housing.

* * * * *

UNITED STATES PATENT AND TRADEMARK OFFICE

CERTIFICATE OF CORRECTION

PATENT NO. : 6,688,225 B2
DATED : February 10, 2004
INVENTOR(S) : Gerald N. Shields It is certified that error appears in the above-identified patent and that said Letters Patent is hereby corrected as shown below:

Column 9,
Line 8, delete "are defined are both defined" and insert instead -- are both defined --.

Signed and Sealed this

Fourteenth Day of June, 2005

JON W. DUDAS
*Director of the United States Patent and Trademark Office*